US007870725B2

(12) United States Patent
Hazelton

(10) Patent No.: US 7,870,725 B2
(45) Date of Patent: Jan. 18, 2011

(54) EXHAUST MOUNTING SYSTEM

(75) Inventor: Gary J. Hazelton, White Lake, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 865 days.

(21) Appl. No.: 11/733,370

(22) Filed: May 18, 2007

(65) Prior Publication Data

US 2008/0283684 A1 Nov. 20, 2008

(51) Int. Cl.
*F01N 1/00* (2006.01)

(52) U.S. Cl. ..... 60/322; 60/272; 60/282; 60/299; 60/311; 60/324; 138/135; 138/136; 285/139.1; 285/205; 285/207; 285/365

(58) Field of Classification Search ..... 60/272, 60/282, 299, 311, 312, 313, 322, 323, 324; 138/135, 136; 285/139.1, 148.8, 148.17, 285/205, 206, 207, 217, 364, 365
See application file for complete search history.

(56) References Cited

U.S. PATENT DOCUMENTS

| | | | | |
|---|---|---|---|---|
| 3,292,887 | A | 12/1966 | Cassel et al. | |
| 4,085,816 | A * | 4/1978 | Amagai et al. | 180/89.2 |
| 4,409,708 | A | 10/1983 | Hauffe | |
| 5,966,933 | A * | 10/1999 | Ishihara et al. | 60/322 |
| 6,141,958 | A * | 11/2000 | Voss | 60/272 |
| 6,438,949 | B1 * | 8/2002 | Nozaki | 60/322 |
| 6,536,548 | B2 * | 3/2003 | Steenackers et al. | 180/89.2 |
| 6,843,516 | B2 * | 1/2005 | Bishop et al. | 285/420 |
| 7,434,656 | B2 * | 10/2008 | Yasuda et al. | 181/227 |
| 7,501,005 | B2 * | 3/2009 | Thaler | 55/523 |

* cited by examiner

*Primary Examiner*—Binh Q. Tran

(57) ABSTRACT

An exhaust mounting system includes an exhaust component having a pair of ridges along an outer perimeter. A mounting band is disposed around the outer perimeter of the exhaust component between the ridges. An isolation pad is disposed between the exhaust component and the mounting bracket for absorbing vibration energy between the mounting band and the exhaust component.

19 Claims, 2 Drawing Sheets

EXHAUST MOUNTING SYSTEM

FIELD

The present disclosure relates to exhaust systems, and more particularly to an exhaust mounting system.

BACKGROUND

The statements in this section merely provide background information related to the present disclosure and may or may not constitute prior art.

Internal combustion engines produce an exhaust gas that is the by-product of the combustion process. The exhaust gas may contain various undesirable constituents such as, for example, carbon monoxide, unburned hydrocarbons, aldehydes, or particulate matter. In order to remove these undesirable constituents from the exhaust gas before the exhaust gas enters the environment, the exhaust gas is directed through an exhaust system connected to the combustion engine. This exhaust system typically includes a pipe that directs the exhaust gas through one or more various exhaust components. The exhaust gas components are operable to remove these undesirable constituents from the exhaust gas. For example, two common exhaust system components used in Diesel engine systems include a Diesel particulate filter and a Diesel oxidization catalyst. Both components remove particulates and other combustion by-products from the exhaust gas stream.

Typically, but not preferably, the exhaust system components are directly mounted to the powertrain or chassis in which they are employed. These direct mounts may include bosses, brackets, and screws. While useful for their intended purpose, it is possible that vibrational energy can pass between the exhaust components and the engine through this direct mounting. This occurs due to directly coupling a large radiating surface (the exhaust component) to an active vibrating structure (the powertrain or chassis). There is also the possibility that the exhaust component can thermally expand and damage the direct mounts of the mounting system that connect the exhaust component to the powertrain or chassis. The exhaust system and its components can also become damaged. Accordingly, there is a need in the art for an improved exhaust mounting system that reduces vibration energy transfer and allows for thermal expansion.

SUMMARY

The present invention provides an exhaust mounting system.

In one aspect of the present invention the exhaust mounting system includes an exhaust component having a pair of ridges or brackets along an outer perimeter. A mounting band is disposed around the outer perimeter of the exhaust component between the ridges. An isolation pad is disposed between the exhaust component and the mounting bracket for absorbing vibration energy between the mounting band and the exhaust component.

In another aspect of the present invention the mounting band grips the exhaust component.

In another aspect of the present invention the exhaust system includes multiple mounting bands.

In still another aspect of the present invention the ridges or brackets are parallel to one another.

In yet another aspect of the present invention the ridges are spaced apart to define a gap, and the gap has a width greater than a width of the mounting band and isolator pad (where applicable).

In still another aspect of the present invention the exhaust component can move relative to the mounting band.

In still another aspect of the present invention the movement of the exhaust component relative to the mounting band is limited by the ridges or brackets contacting the mounting band.

In still another aspect of the present invention the ridges are welded onto an outer surface of the exhaust component.

In yet another aspect of the present invention the ridges are hydroformed in an outer surface of the exhaust component.

In yet another aspect of the present invention the ridges are located centrally on a cylindrical portion of the exhaust mounting system.

In still another aspect of the present invention the mounting band acts to damp vibration of the exhaust component by pressing and applying a load on the exhaust component surface.

In still another aspect of the present invention the mounting band includes a mounting bracket for connecting the mount band to a component of a powertrain.

In still another aspect of the present invention the isolation pad is a wire mesh.

In yet another aspect of the present invention, the isolation pad is made from a material such as HT silicon, an aggregate, or another environmentally suitable material.

In still another aspect of the present invention the isolation pad runs along the entire perimeter of the exhaust component.

In yet another aspect of the present invention the isolation pad is a discrete element that runs along a portion of the perimeter of the exhaust component.

In yet another aspect of the present invention the isolation pad extends around at least one side of the mounting band.

In still another aspect of the present invention the exhaust component is a Diesel particulate filter.

In still another aspect of the present invention the exhaust component is a Diesel oxidation catalyst.

In yet another aspect of the present invention the exhaust component is a pipe.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
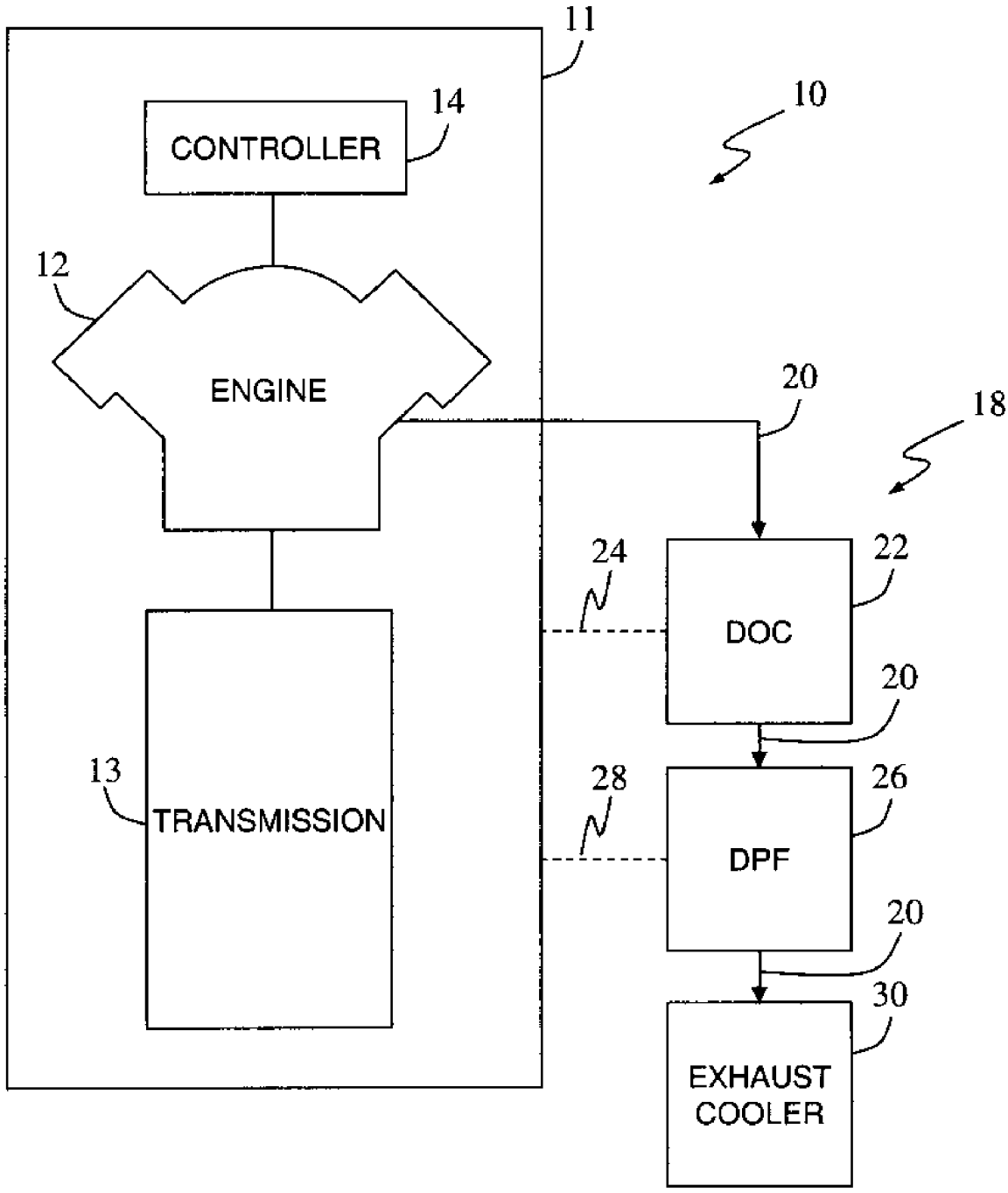
FIG. 1 is a schematic view of an exemplary Diesel engine system having a plurality of exhaust components employing the exhaust mounting system of the present invention.

With reference to FIG. 1, an exemplary Diesel engine system is illustrated and generally indicated by reference number 10. While the engine system 10 is illustrated as a Diesel engine system, it should be appreciated that various other kinds of internal engines may be employed with the present invention, such as, for example, hybrid-electric engines or gasoline internal combustion engines. The Diesel engine system 10 is preferably employed in a motor vehicle (not shown), though the Diesel engine system 10 may be used in various other applications without departing from the scope of the present invention. The Diesel engine system 10 generally includes a powertrain 11. The powertrain 11 generally includes a Diesel engine 12 coupled to a transmission 13. The powertrain 11 may also include various other components such as, for example, a torque converter, a prop shaft, one or more differentials, and a plurality of axle shafts. The powertrain 11 is operable to provide an output to a plurality of wheels. It should be appreciated that the powertrain 11 may include various other components without departing from the scope of the present invention.

The Diesel engine 12 is in electronic communication with an engine controller 14. The engine controller 14 is operable to control the Diesel engine 12 based on various parameters. The Diesel engine 12 is operable to combust Diesel fuel (not shown) in a combustion process within the Diesel engine 12. The by-product of this combustion process is an exhaust gas. The exhaust gas is discharged from the Diesel engine 12 as an exhaust gas stream into an exhaust system 18.

The exhaust system 18 includes a pipe 20 that carries the exhaust gas stream from an exhaust manifold (not particularly shown) on the Diesel engine 12 to a first exhaust component 22. In the particular example provided, the first exhaust component 22 is a Diesel oxidation catalyst (DOC). However, it should be appreciated that the first exhaust component 22 may take various forms other than a DOC without departing from the scope of the present invention. The DOC 22 is mounted to the powertrain 11, as indicated schematically by dashed line 24. The DOC 22 is operable to filter the exhaust gas to meet applicable emissions standards. More specifically, the DOC has a porous ceramic structure that is coated with a catalytic material. As the exhaust gas stream enters the DOC, the catalytic material catalyzes a chemical reaction with specific undesirable constituents within the exhaust gas stream in order to eliminate those undesirable constituents from the exhaust gas stream.

The pipe 20 then carries the exhaust gas stream from the DOC 22 to a second exhaust component 26. In the particular example provided, the second exhaust component 26 is a Diesel particulate filter (DPF). However, it should be appreciated that the second exhaust component 26 may take various forms other than a DPF without departing from the scope of the present invention. The DPF 26 is mounted to the powertrain 11, as indicated schematically by dashed line 28. The DPF 26 is operable to filter the exhaust gas to meet applicable emissions standards. More specifically, The DPF 26 includes a ceramic structure through which the exhaust gas stream passes. Particulates within the exhaust gas stream are trapped and accumulate on the walls of the ceramic structure until such time as they are burned off in a regeneration process using hot exhaust gasses.

The exhaust gas stream passes from the DPF 26 to a tailpipe section that includes an exhaust cooler 30. The exhaust cooler 30 acts to cool the exhaust gas stream before the exhaust gas stream enters the surrounding environment.

Figure 2:
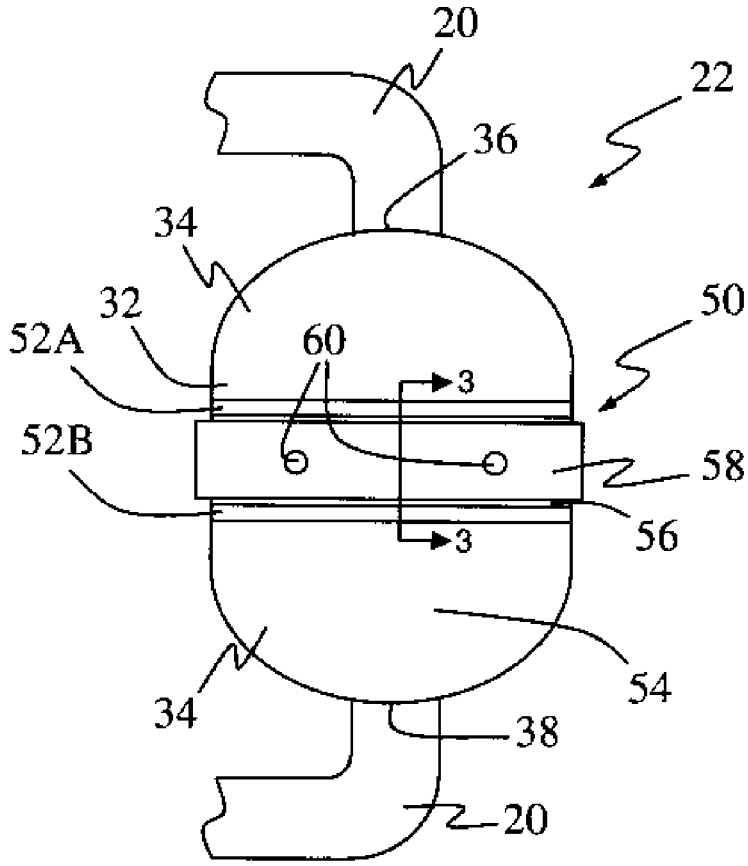
FIG. 2 is an enlarged, schematic, top view of an exhaust component having the exhaust mounting system of the present invention.

Turning now to FIG. 2, the first exhaust component 22 is shown and generally includes a generally cylindrical body 32 having hemi-spherical ends 34. An inlet port 36 is located at one hemispherical end 34 and is coupled to the pipe 20 in order to receive the exhaust gas stream. An outlet port 38 is located at an opposite hemispherical end 34 and is coupled to the pipe 20 in order to discharge the treated exhaust gas stream. It should be appreciated that the shape of the first exhaust component 22 may take various forms without departing from the scope of the present invention.

Figure 3:
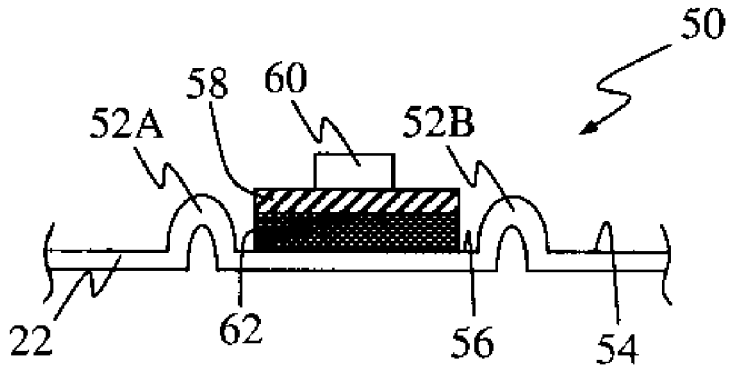
FIG. 3 is an enlarged cross-sectional view of the exhaust mounting system of the present invention taken in the direction of arrows 3-3 in FIG. 2.

An exhaust mounting system 50 according to the principles of the present invention couples the first exhaust component 22 to the powertrain 16. The exhaust mounting system 50 includes a first ridge 52A and a second ridge 52B located on the first exhaust component 22. The ridges 52A and 52B are located generally centrally on an outer surface 54 of the cylindrical body 32 and extend around the entire outer circular perimeter of the cylindrical body 32. The first ridge 52A is positioned parallel to the second ridge 52B and the ridges 52A and 52B are spaced apart to define a gap 56 therebetween. The gap is sized to allow for thermal expansion and/or contraction of the exhaust mounting system 50. In the particular example provided, the ridges 52A and 52B are hydroformed as part of the outer surface 54 of the first exhaust component 22, as best seen in FIG. 3. However, the ridges 52A and 52B may alternatively be formed separately and welded to the outer surface 54 of either exhaust component 22, 24. The ridges 52A and 52B may further be brackets that are mechanically coupled to the exhaust components 22, 24. The ridge 52A and 52B may extend around the entire perimeter of the exhaust components 22, 24. The length of the ridges 52A and 52B is based on loading requirements, isolation requirements, mass of the relevant parts, size of the relevant parts, mass requirements, and possibly cost requirements.

With continued reference to FIG. 2, the exhaust mounting system 50 further includes a mounting band 58. The mounting band 58 is generally annular in shape and extends around the first exhaust component 22. The mounting band 58 is sized to grip the first exhaust component 22 between the first ridge 52A and the second ridge 52B within the gap 56. The width of the mounting band 58 is less than the width of the gap 56. The mounting band 58 is preferably formed from a rigid sheet metal, though various other materials may be employed.

The mounting band 58 includes a plurality of mounting brackets 60. The mounting brackets 60 are operable to attach the exhaust mounting system 50 and in turn the first exhaust component 22 to the powertrain 16.

Turning now to FIG. 3, the exhaust mounting system 50 further includes an isolation pad 62. The isolation pad 62 is sandwiched between the mounting band 58 and the outer surface 54 of the first exhaust component 22. The isolation pad 62 may extend along the entire outer perimeter of the first exhaust component 22, or may form a discrete section that extends under only a portion of the mounting band 58. In this latter embodiment, more than one discrete isolation pad 62 may be employed with the present invention. The mounting band 58 may contain a spring (not shown) to control the isolation pad 62 in order to preload the isolation pad 62 during expansion and contraction due to temperature changes in the exhaust mounting system 50.

The isolation pad 62 is preferably a knitted wire mesh or other suitable isolator material. The knitted wire mesh acts as a physical barrier between the outer surface 54 of the first exhaust component 22 and the mounting band 58. Additionally, the knitted wire mesh structure converts vibration energy to thermal energy, effectively dampening, absorbing, and dissipating vibration between the first exhaust component 22 and the mounting band 58 (and in turn the powertrain 16).

In the particular example provided, the isolation pad 62 has a width approximately equal to the width of the mounting band 58. However, it should be appreciated that the isolation pad 62 could extend around the sides of the mounting band 58 or have a width less than the width of the mounting band 58.

The isolation pad 62 may further be secured to the mounting band 58 by cutouts (not shown) formed in the mounting band 58 sized to receive the isolation pad 62 therein.

With combined reference to FIGS. 2 and 3, as noted above, the mounting band 58 and isolation pad 62 grip the first exhaust component 22. As the exhaust component 22 is heated, either by normal operational exhaust gas or by hot exhaust gas during a DPF regeneration process, the first exhaust component 22 will tend to thermally expand. As the first exhaust component 22 thermally expands it will "slip" or move within the grip of the mounting band 58 and isolation pad 62. The ridges 52A and 52B restrict the movement of the first exhaust component 22 by contacting the mounting band 58 and/or isolation pad 62. Accordingly, the gap 56 between the ridges 52A and 52B is sized to provide an outer limit on the range of motion of the first exhaust component 22 relative to the mounting band 58 during thermal expansion. This ability of the exhaust mounting system 50 to allow the first exhaust component 22 to slip during thermal expansion reduces stress on the mounting brackets 60.

While the exhaust mounting system 50 has been shown in use with the first exhaust component 22 exemplified as a DOC, it should be appreciated that the exhaust mounting system 50 may be employed with the second exhaust component 26 exemplified as a DPF, or any other exhaust system component.

The description of the invention is merely exemplary in nature and variations that do not depart from the gist of the invention are intended to be within the scope of the invention. Such variations are not to be regarded as a departure from the spirit and scope of the invention.

What is claimed is:

1. An exhaust mounting system comprising:

an exhaust component having a pair of ridges along an outer perimeter, wherein the exhaust component is one of a particulate filter and an oxidization catalyst;

a mounting band disposed around the outer perimeter of the exhaust component between the ridges; and an isolation pad disposed between the exhaust component and the mounting band for absorbing vibration energy between the mounting band and the exhaust component.

2. The exhaust mounting system of claim 1 wherein the mounting band grips the exhaust component.

3. The exhaust mounting system of claim 2 wherein the ridges are parallel to one another.

4. The exhaust mounting system of claim 3 wherein the ridges are spaced apart to define a gap, and the gap has a width greater than a width of the mounting band in order to allow for thermal expansion and contraction of the exhaust component.

5. The exhaust mounting system of claim 4 wherein the exhaust component can move relative to the mounting band.

6. The exhaust mounting system of claim 5 wherein the movement of the exhaust component relative to the mounting band is limited by the ridges contacting the mounting band.

7. The exhaust mounting system of claim 1 wherein the ridges are brackets coupled to a surface of the exhaust component.

8. The exhaust mounting system of claim 1 wherein the ridges are welded onto an outer surface of the exhaust component.

9. The exhaust mounting system of claim 1 wherein the ridges are hydroformed in an outer surface of the exhaust component.

10. The exhaust mounting system of claim 1 wherein the ridges are located centrally on a cylindrical portion of the exhaust mounting system.

11. The exhaust mounting system of claim 1 further comprising a plurality of mounting bands, each mounting band disposed between a pair of ridges located on the exhaust component.

12. The exhaust mounting system of claim 1 wherein the mounting band includes a mounting bracket for connecting the mount band to a component of a powertrain.

13. The exhaust mounting system of claim 1 wherein the isolation pad is a wire mesh.

14. The exhaust mounting system of claim 13 wherein the isolation pad runs along the entire perimeter of the exhaust component.

15. The exhaust mounting system of claim 13 wherein the isolation pad is a discrete element that runs along a portion of the perimeter of the exhaust component.

16. The exhaust mounting system of claim 13 wherein the isolation pad extends around at least one side of the mounting band.

17. The exhaust mounting system of claim 1 wherein the exhaust component is a Diesel particulate filter.

18. The exhaust mounting system of claim 1 wherein the exhaust component is a Diesel oxidation catalyst.

19. An exhaust mounting system comprising:

an exhaust component having a cylindrical portion that defines an axis, the cylindrical portion having an outer surface and a pair of spaced apart parallel ridges that are integrally formed in the outer surface, wherein the pair of spaced apart parallel ridges extend a distance above the outer surface and circumscribe the cylindrical portion, wherein the spaced apart parallel ridges are centrally located along the axis on the cylindrical portion, and wherein the exhaust component is one of a particulate filter and an oxidization catalyst;

an isolation pad disposed between the pair of spaced apart parallel ridges and in contact with the outer surface of the exhaust component; and a mounting band disposed between the ridges and overtop the isolation pad, wherein the isolation pad is configured to absorb vibration energy between the mounting band and the exhaust component, and wherein the pair of spaced apart parallel ridges are spaced to allow the exhaust component to move relative to the mounting band in a direction parallel to the axis and wherein the distance that the pair of spaced apart parallel ridges extend above the outer surface is greater than a distance between the mounting band and the outer surface.

* * * * *